United States Patent [19]

Kuyper et al.

[11] 4,086,727

[45] May 2, 1978

[54] PIVOT WINDOW CONSTRUCTION

[75] Inventors: Herman S. Kuyper, Knoxville; Tad B. Anthony; Robert S. Evers, both of Pella, all of Iowa

[73] Assignee: Rolscreen Company, Pella, Iowa

[21] Appl. No.: 653,306

[22] Filed: Jan. 29, 1976

[51] Int. Cl.[2] ..... E05F 7/02

[52] U.S. Cl. ..... 49/255; 49/258; 49/260; 49/394; 292/DIG. 49; 292/263

[58] Field of Search ..... 49/254–257, 49/259, 260, 390, 394, 191; 292/263, DIG. 49

[56] References Cited

U.S. PATENT DOCUMENTS

| | | | |
|---|---|---|---|
| 2,791,456 | 5/1957 | Roehl et al. | 292/263 |
| 3,768,204 | 10/1973 | Anderberg et al. | 49/390 |
| 3,927,492 | 12/1975 | Carson | 49/394 X |

FOREIGN PATENT DOCUMENTS

| | | | |
|---|---|---|---|
| 1,027,101 | 3/1958 | Germany | 49/254 |
| 514,342 | 2/1955 | Italy | 49/255 |

*Primary Examiner*—Philip C. Kannan

*Attorney, Agent, or Firm*—Allegretti, Newitt, Witcoff & McAndrews

[57] ABSTRACT

A horizontal pivot window construction. The window includes a window frame having a sill, a head, and a pair of upright jambs which interconnect the ends of the sill with the ends of the head. The window sash is mounted within the frame and the sash includes upper and lower rails and upright stiles which interconnect the opposite ends of the upper and lower rails. Means are provided for supporting the window sash within the window frame for movement of the sash between a closed and locked position and an open and unlocked position. The supporting means includes means for pivotally mounting the sash within the frame for movement about a substantially horizontal axis so as to make the normal exterior side of the window accessible from the interior of the room in which the window is located. The supporting means also includes a member for vertically moving the sash between an upper position and a lower position when the stiles and the jambs are substantially coextensive with each other. The upper position corresponds to the closed and locked position of the sash within the frame. Cooperating means are mounted on the sash, on the frame, and on the vertical moving member so as to prevent sideways, front, back, upward and downward movement of the sash within the frame only when the sash is in the upper, closed and locked position.

24 Claims, 18 Drawing Figures

PIVOT WINDOW CONSTRUCTION

BACKGROUND OF THE INVENTION—FIELD OF THE INVENTION AND DESCRIPTION OF THE PRIOR ART

This invention relates to a window construction of the type which is pivotable about an axis, such as a horizontal axis, so as to make the normal exterior side of the window accessible for cleaning and maintenance from the interior, and it particularly relates to such a window construction which is principally constructed of wood and which is primarily intended for use in commercial, industrial and apartment buildings.

In designing the constructing windows for such industrial or commercial use, considerations are quite different from the design and construction of windows for home use. Although window maintenance is always an important factor, whether for commercial type use or home use, maintenance costs, particularly exterior maintenance, are an extremely important factor in designing windows which are to be used in commercial buildings. Because of the maintenance factor, it has probably been more common to use metallic windows rather than wood windows for commercial use. The basic advantages of a wood window are little or no condensation problems on the frame and sash during cold weather, overall better insulating value than metal windows and a more aesthetically pleasing appearance than metal windows. In commercial buildings, including apartment buildings, these advantages are sacrificed because of greater maintenance problems required on the exterior, such as for painting. Now, however, the exterior of the windows may be constructed of or protected by metal, such as aluminum parts, while the interior can remain as wood. The exterior of the wood window sashes may be covered or clad with aluminum panels, such as described in U.S. Pat. No. 3,815,285. With the metal exterior, maintenance problems are greatly alleviated as exterior painting and maintenance of the windows are almost non-existent, even with windows made principally of wood, but which retain the principal advantages of wood windows.

In addition to the maintenance problems of windows used on commercial, industrial or apartment buildings, it is important for the glass and sash to be securely mounted within the frame. In recent times, there have been a number of well-known high rise buildings wherein the window glass has actually fallen out of the structure. In modern architectural designs for commercial buildings, large glass windows are frequently used. Because of high winds, these large glass windows break and/or fall from the buildings. In addition to the security problem, the sash should be as easy as possible to remove from the frame, if removal is desirable or necessary. Also, because of high winds and heavy rains, not only must the glass and sash be securely mounted within the frame, but the weather seal must be designed to assure that the "waterfall" effect of rain water does not cause leaking of water from the exterior into the interior.

Many windows, whether metal or wood, have the sash pivot about a horizontal axis or a vertical axis so that the exterior of the window glass can be washed or maintained from the interior. In such a construction, however, it is extremely important that the mounting of the pivoting sash within the frame and/or the mounting of the glass within the sash are to be secured in place without any significant risk that the sash could fall from the frame or the glass from the sash. The weather seals on the windows must be designed so as to prevent water leakage from the exterior into the interior. Also, it is desirable for the operation, that is, the opening and closing, of the window to be simple and, during movement of the window to the open position, there is to be assurance that the sash is to be securely mounted within the window so that there is substantially no danger or risk of the window sash becoming disengaged from the window frame.

SUMMARY OF INVENTION

It is therefore an important object of this invention to provide an improved window construction, particularly for use with commercial, industrial, or apartment buildings, wherein the window is substantially maintenance free, the window glass, on its exterior side, is accessible for cleaning from the interior of a room, and the glass and window sash are securely mounted in place without any significant danger of becoming disconnected from the window frame whether the window is in the closed and locked position or in the open position.

It is also an object of this invention to provide an improved window construction, primarily made of wood, with a substantially maintenance free exterior, a wooden interior, a horizontally pivotable window sash, and a uniquely constructed support system for the sash within the frame, both when in the open position and when in the closed position.

It is a further object of this invention to provide a uniquely constructed horizontally pivotal window sash mounted within a window frame wherein a single locking member serves not only to lock the window in the locked position, but additionally serves to vertically lift the sash within the frame for movement from the unlocked position to the locked position and which also maintains the window sash in an upper locked position, thereby serving three distinct and important functions.

It is yet another object of this invention to provide a unique support mechanism for a sash within a window frame wherein the frame is pivotally supported about a horizontal axis, when in the open position, and, when in the closed position, is locked into a fixed position relative to the frame by cooperating means on the sash, on the frame, and on a unique locking member.

It is still another object of this invention to provide a unique mechanism for lifting a window sash within a window frame by the fulcrum action of a locking member, accessible from the interior, the lifting action being assisted by spring members for the sash mounted in the frame.

It is yet another object of this invention to provide a support member for supporting a sash for pivotal movement about a horizontal axis wherein the pivotal support is sturdy and which substantially eliminates the possibility of the sash becoming disengaged from the frame as the window sash is being pivoted between the open and closed positions and cooperating means are provided for holding the window sash within the window frame by interengagement at the top and bottom of the sash only after the sash is lifted upwardly, by an operating mechanism, to the upper, closed and locked position.

It is still another object of this invention to provide an improved window construction for supporting a window frame for pivotal movement about a horizontal axis and for also assuring secure interengagement between the window frame at all times during use.

Further purposes and objects of this invention will appear as the specification proceeds.

The foregoing objects are accomplished by our window structure which includes a fixed window frame which comprises a sill, a head, and a pair of upright jambs interconnecting the sill with the head, a window sash having upper and lower rails and upright stiles interconnecting the upper and lower rails, means for supporting the sash within the frame for movement between the closed and locked position and an open and unlocked position, the supporting means including means for pivotally mounting the sash within the frame for movement about a substantially horizontal axis for thereby making the normal exterior side of the window accessible from the interior side, the supporting means further including means for vertically moving the sash between an upper position and a lower position when the stiles and the jambs are substantially coextensive with each other, and cooperating means are provided on the sash, on the frame, and on the vertical moving means for preventing sideways, forward, rearward, and up and down movement of the sash within the frame only when the frame is in the upper, closed and locked position.

BRIEF DESCRIPTION OF THE DRAWINGS

One particular embodiment of the present invention is illustrated in the accompanying drawings wherein.

DETAILED DESCRIPTION OF THE PREFERRED EMBODIMENT

Figure 1:
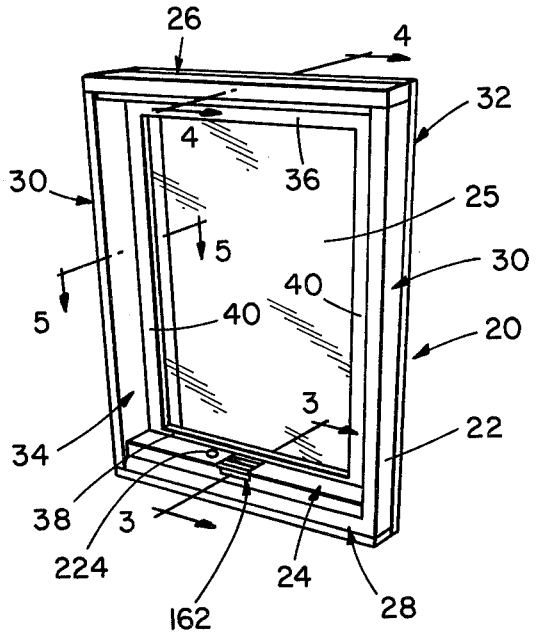
FIG. 1 is a pictorial view of our improved horizontally pivoted window construction, as seen from the interior.

Referring to the drawings, there is shown a window construction, generally 20, which has been constructed in accordance with our invention. The window 20 includes a fixed window frame, generally 22, which is fixedly secured within an exterior wall (not shown) of a room. A window sash, generally 24, is mounted within the frame 22 and is pivotally carried about a horizontal axis within the frame 22, in a manner to be hereinafter described in detail. It is to be understood that the term "frame", as used herein, is meant to include the fixed portion of the window in which the pivoted sash 24 is carried.

The frame 22 generally includes a head, generally 27, a sill, generally 28, spaced vertically downwardly from the head 26, and a pair of transversely spaced, substantially upright jambs, generally 30, which interconnect the opposite ends of the head 26 to the opposite ends of the sill 28. As will be described hereinafter in detail, the head 26, the sill 28, and the jambs 30 include a metallic exterior portion, generally 32, and a wood interior portion, generally 34. The frame exterior 32 for each of the head 26, the sill 28, and the jambs 30 is rigidly secured to the wood interior portion 34 by suitable means, to be hereinafter described.

Figure 11:
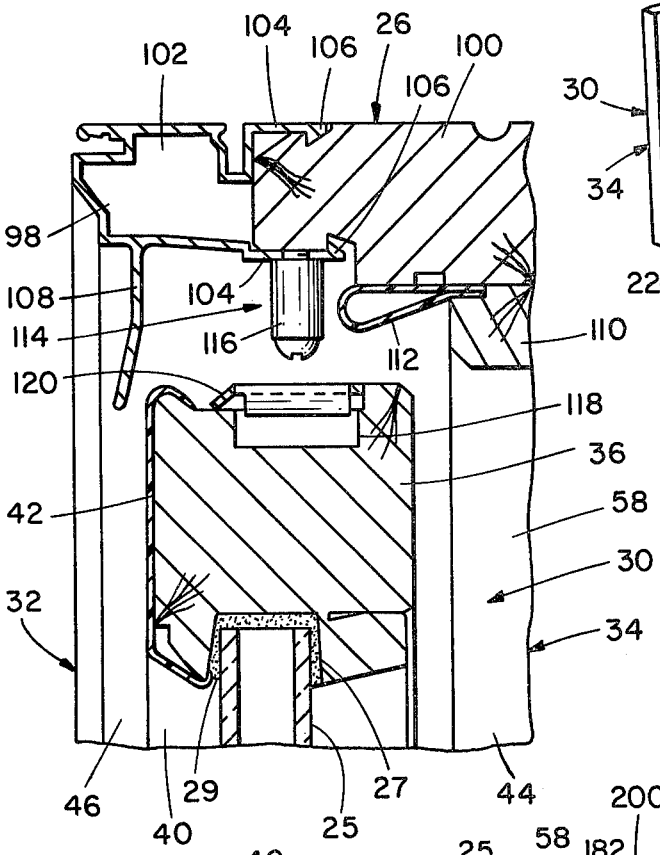
FIG. 11 is a sectional view similar to FIG. 4, except showing the window sash lowered relative to the frame.
Figure 9:
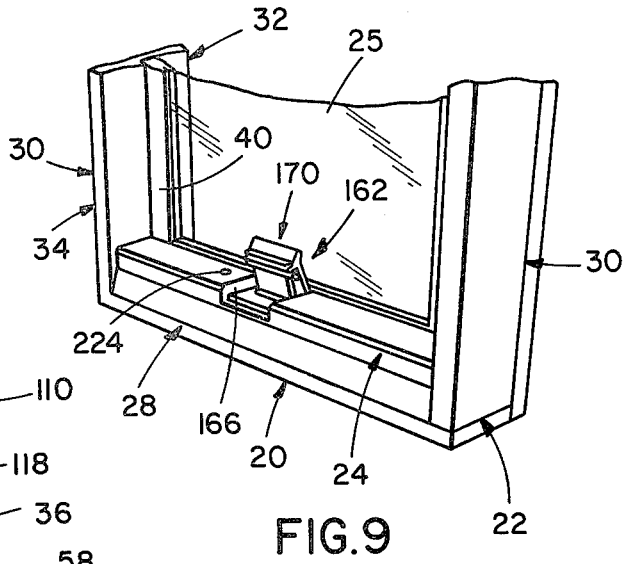
FIG. 9 is a partially broken pictorial view of the operator-latch member in the released position when the window sash is in a lowered position relative to the frame.

The window sash 24 includes an upper rail, generally 36, a lower rail, generally 38, spaced vertically below the upper rail 36, and a pair of laterally spaced, generally upright stiles, generally 40, which rigidly interconnect the opposite ends of the upper rail 36 to the opposite ends of the lower rail 38. A double glazing panel or insulating glass panel 25 is fixedly mounted within a continuous rabbet 27 defined in each of the rails 36 and 38 and stiles 40. The glass 25 is sealably embedded in a sealing material 29 in the rabbet 27. Preferably, the rails 36 and 38 and stiles 40 are constructed of wood while as seen, for example, in FIG. 3, the exterior, exposed portions thereof are covered or clad by metallic panels, generally 42, which function to protectively cover the exterior of the wood sash 24. The metal panels or cladding 42 is rigidly interconnected to each of the rails 36 and 38 and stiles 40 in the manner described in U.S. Pat. No. 3,815,285 of Herman S. Kuyper, entitled "Covered Window Sash and Method for Making the Same." The overall external dimensional height of the sash 24 is slightly less than the internal dimensional height of the window so that the sash can be moved vertically from the position shown in FIGS. 3 and 4, the extreme upper position of the sash, and FIGS. 10 and 11, the extreme lower position.

Since the exterior 32 of the window frame 22 is preferably constructed of extruded aluminum (preferably colored by anodizing or by painting to provide the desired color and to be weather resistant) and since the sash 24 is covered by the aluminum cladding 42 (also anodized or painted to provide the desired color and to provide weather resistance), the entire exterior portion of the window structure 20 that is normally exposed to weather conditions is weather resistant and substantially maintenance free, as no normal exterior maintenance is required, as painting or the like. In addition to this significant advantage of the applicant's construction is the advantage of utilizing a wood interior portion 34 for the interior of both the frame 22 and the sash 24. With this wood construction, far better insulation is provided than with metal frames and sashes to thereby avoid "sweating" or condensation of interior water on the frame 22 and sash 24, which is generally the situation even with the most expensive and high quality metal frames and sashes. In addition, the aesthetic interior appearance of wood is considered to be a significant advantage over the appearance of a metallic frame and sash.

Figure 5:
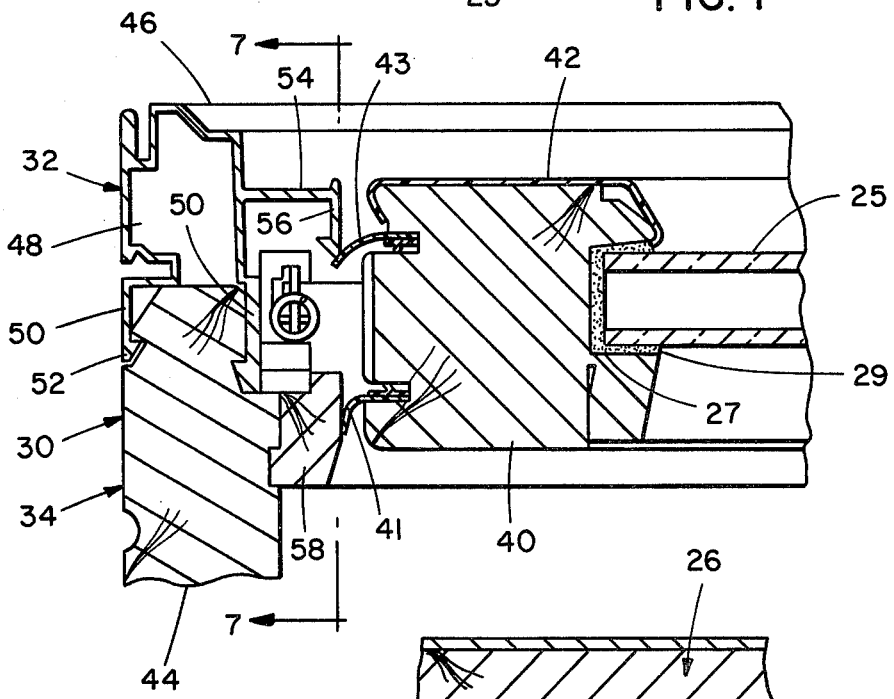
FIG. 5 is an enlarged sectional view taken along the line 5—5 of FIG. 1 illustrating the relationship between the jamb of the frame and the stiles of the window sash.

Referring to FIG. 5, there is shown a detailed sectional view through one of the window jambs 30 of the frame 22 and through one of the stiles 40 of the window sash 24. The jamb 30 includes a wood interior section, generally 44, and an extruded aluminum exterior metal jamb, generally 46. The metal jamb section 46 includes an outwardly projecting hollow portion 48 which is unitary with a pair of inwardly directed legs 50 which are constructed and arranged with hook sections 52 thereon for slidably engaging the outermost portion of the wood jamb section 44 in order to provide for rigid securement therebetween. The hollow section 48 includes a unitary L-shaped projection 54 which extends laterally toward the sash 24. The L-shaped projection 54 includes an inwardly projecting outer leg 56 which, as will be described hereinafter, assists in defining a weather seal between the frame 22 and the sash 24.

The wood interior jamb section 44 includes an upright, inner wood strip 58 which is rigidly secured in place, by any suitable means. The wood strip 58 is spaced directly inwardly from the L-shaped projection 54 of the metal jamb section 46. The wood strip 58 also assists in defining a suitable weather seal between the frame 22 and the sash 24.

An inner flexible seal 41 and an outer flexible seal 43 are secured, in spaced relationship with each other, along the outer edge of each stile 40. The free edge of the inner flexible seal 41 sealably bears against the wood strip 58 and the free edge of the outer flexible seal 43 bears against the L-shaped leg 51, the seals 41 and 43 thereby defining two separate spaced seals between each jamb 30 and each stile 40, while defining an insulating air space therebetween. The two seals 41 and 43 also cooperate to provide a rain screen effect, that is, the outer seal 43 substantially avoids the passage of rain water in view of the substantially equal pressure on both sides thereof.

Figure 7:
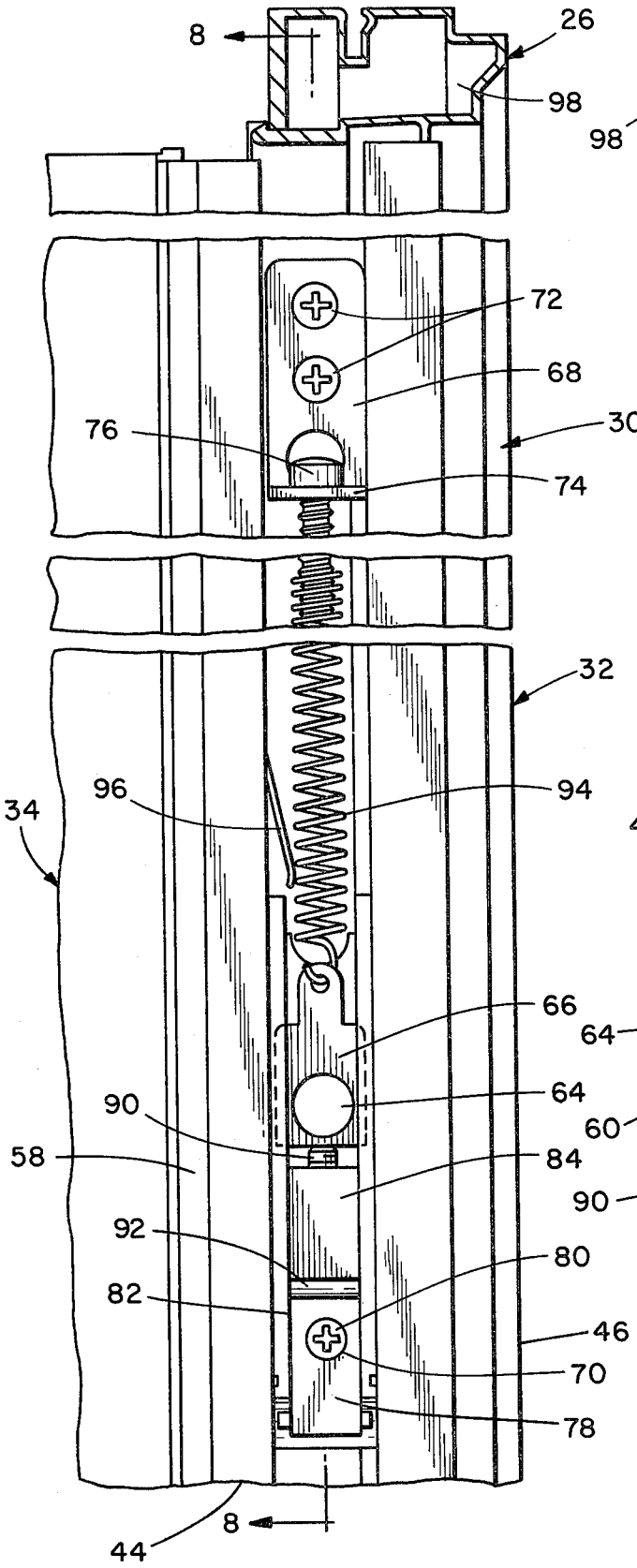
FIG. 7 is a sectional view, partially broken, taken along the line 7—7 of FIG. 5 illustrating spring members used for assisting in lifting the window sash to the upper, closed and locked position.
Figure 8:
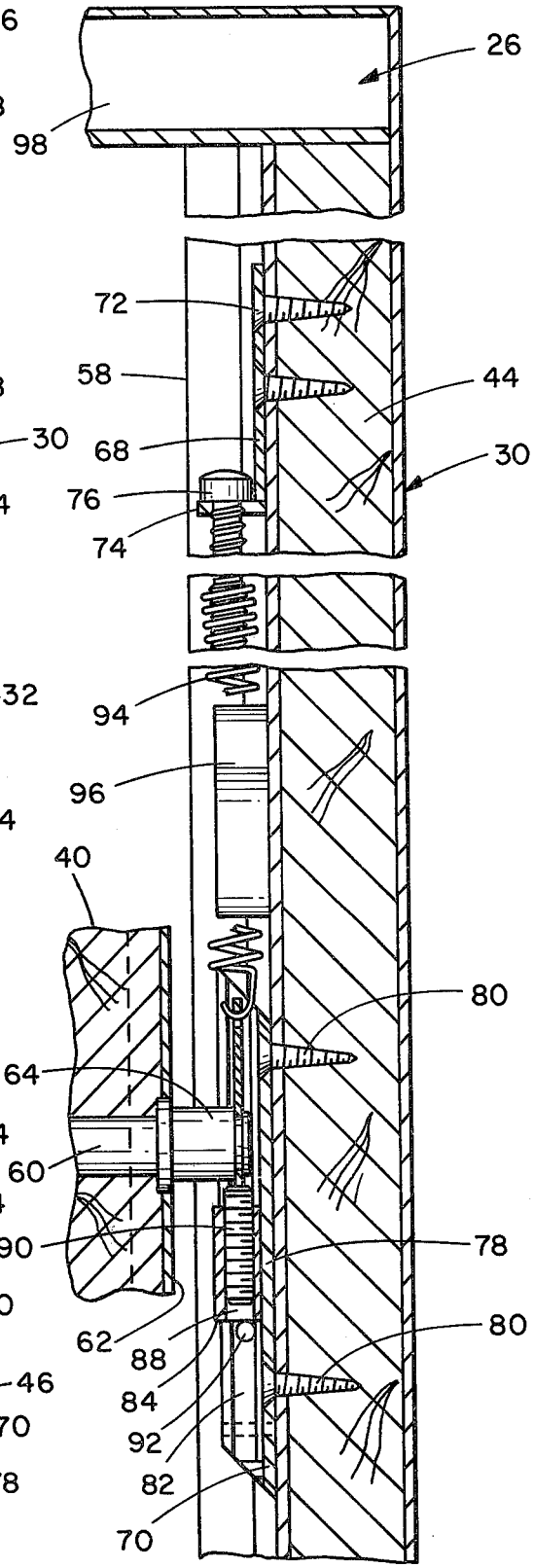
FIG. 8 is a sectional view taken along the line 8—8 of FIG. 7.

Referring to FIGS. 7 and 8, the pivot mounting of the sash 24 within the frame 22 is shown in detail. A rigid pivot pin 60 is fixedly embedded within each edge of each of the stiles 40 of each sash 24, the location of each pivot pin 60 being located slightly laterally outwardly of the center of gravity of the sash assembly 24, when the sash 24 is in a horizontal position. In this way, the sash 24 is normally pivoted to the downward position by gravity, that is, to the position at which the lower rail 38 of the sash 24 is pivoted towards the sill 28 of the frame 22. A pivot pin securing plate 62 is rigidly embedded within the outer edge of each of the stiles 40 and acts to reinforce the rigid securement of the pin 60 within each of the stiles 40. The pin 60 includes a laterally projecting portion 64, extending towards the jamb 30, which, at its outer end, includes a spring mounting bracket 66 which is affixed thereon.

As seen in FIGS. 5, 7 and 8, an upper spring mounting bracket 68 and a lower spring guide bracket 70 are rigidly secured to the inner edge of each jamb 30. The upper bracket 68 is positioned on the outer edge of the jamb 30 substantially intermediate the L-shaped projection 54 of the metal jamb section 46 and the wood strip 58 of the wood jamb section 44. The upper bracket 68 includes an upright plate portion which is secured to the jamb 30 by screws 72. The bracket 68 includes an arm 74 which projects toward the sash 24. The arm 74 has an aperture therein which carries a threaded stud 76 which has its threaded portion directed downwardly.

The lower spring mounting bracket 70 includes a flat, upright mounting base 78 which is rigidly secured to the jamb 30 by means of screws 80. The lower bracket 70 further includes a pair of guide tracks 82, which are unitary with the base section 28 and which project towards the sash 24. The guide tracks 82 slidably carry a lower stop 84. The lower stop 84 is slidably received within the guide tracks 82 for upper and downward movement therein and relative to the guide tracks 82. The stop 84 includes a threaded aperture 88 which threadably receives an upright threaded stop pin 90. A fixed stop pin 92 is transversely positioned below the slidable stop 84 at a selected vertical position along the guide tracks 82 in order to provide a fixed lower stop position for the slidably bar 86.

The spring bracket 66 which is secured to the outer end of the projecting portion 64 of the pivot pin 60 is also guidably and slidably received within the guide tracks 82, as seen in FIG. 7. A tension spring 94 is threadably and adjustably received on the upper threaded stud 76, at its upper end, and the lower end of the spring 94 is received by the spring mounting bracket 66, as seen in FIGS. 7 and 8. As will be described hereinafter, the spring 94 normally biases the sash 24 upwardly, that is, to a position at which the upper rail 36 of the sash 24 is biased upwardly towards the head 26 of the frame 22. The weight of the sash 24 normally overcomes the upward biasing force of the springs 94 so that in the unlocked condition, as will be described, the sash 24 moves vertically downwardly, relative to the frame 22, as will be described hereinafter.

A movable leaf spring stop 96 is positioned above the spring bracket 66 mounted on the pivot pin 60 so that the bracket 66 may be selectively moved out of engagement with the guide tracks 82 so that the entire sash 25 may be moved from interconnection with the frame 22. The spring stop 96 is secured to the jambs in such a way, as seen best in FIG. 7, to normally prevent upward movement or disengagement of the spring bracket 66 from engagement with the guide tracks 82. The outwardly biased portion of the spring stop 96 may be manually pressed inwardly so as to move out of a normal interfering stop position relative to the bracket 66 for removal of the sash 24.

Figure 4:
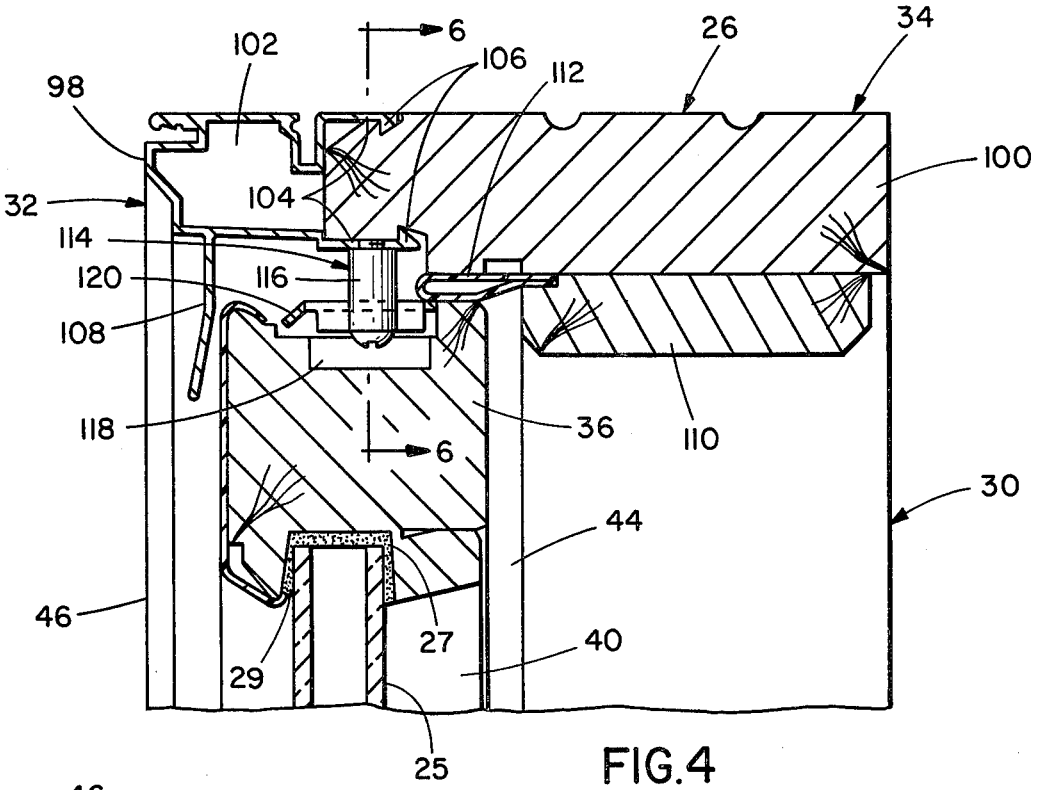
FIG. 4 is an enlarged sectional view taken along the line 4—4 of FIG. 1 illustrating the sash in the locked position, particularly illustrating the interrelationship between the head of the frame and the upper rail of the sash.

Referring to FIG. 4, there is shown a cross-sectional view through the head 26 of the frame 22 and through the upper rail 36 of the sash 24. With respect to the construction of the sash 24, the cross-section through the upper rail 36 and lower rail 38 is substantially the same as that through the stile 40 of the sash, as discussed above, that is, the sash is constructed primarily of wood and includes metal cladding 42 thereover. As to the frame 22, the head 26 includes a metallic exterior portion, generally 98, and a rigidly interconnected wood interior portion, generally 100. The metal exterior portion 98 includes a hollow section 102 and a pair of interconnecting legs 104 which, like the hollow section 48 of the jamb 38, include hooks 106 for providing positive slidable interengagement between the wood interior section 100 and the metallic exterior portion 98 of the frame head 26. The hollow outer section 102 includes a downwardly projecting flange 108 which extends below the upper edge of the upper rail 36 of the sash 24 to provide a wind break and water deflector for assisting in providing a weather seal between the sash 24 and the frame 22. The flange 108 also assists in assuring that the sash cannot fall from the frame as a result of, for example, the "negative window load" effect that tends to pull the sash outwardly from the structure during high winds.

The wood section 100 of the head 26 includes an upper wood strip 110 which is positioned along the inner face of the wood section 100. A flexible weather strip 112 is securely positioned between the wood strip 110 and the main body of the wood interior jamb section 100, as best seen in FIG. 4. The strip 112 is normally compressed between the wood frame section 100 and the upper edge of the upper rail 36 of the window sash 24 to thereby provide a positive weather seal between the movable sash 24 and the fixed frame 22.

Figure 6:
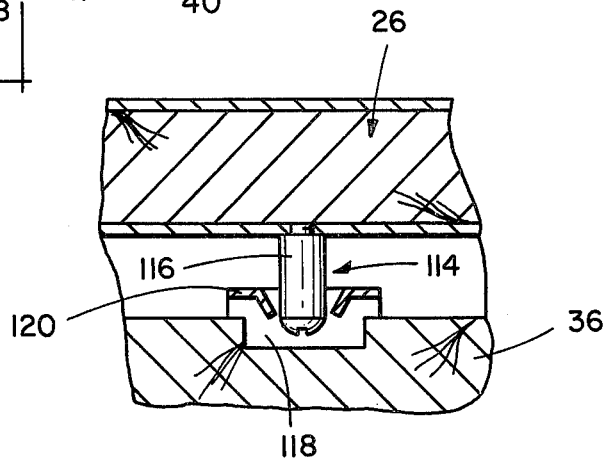
FIG. 6 is a detailed sectional view, partially broken, taken along the line 6—6 of FIG. 4 illustrating an interlock between the upper rail of the sash and the head of the frame.

Referring to FIGS. 4 and 6, there is shown an upper interlock assembly, generally 114, between the upper rail 36 and the head 26 of the frame 22. The interlock 114 includes a rigid pin 116 which projects downwardly from the central portion of the head 26 towards the upper edge of the upper rail 36 of the sash 24. The upper edge of the upper rail 36, at its central portion, includes a cut-out portion 118 which is surrounded by a metal clip 120 which is also rigidly secured to the upper edge of the upper rail 36 and is constructed and arranged to guidably receive the downwardly projecting rigid pin 116 on the head 26. The interlock assembly 114, when the sash is closed and locked relative to the frame 22, assists in holding the upper end of the sash 24 in a fixed relative position to the frame 22.

Figure 3:
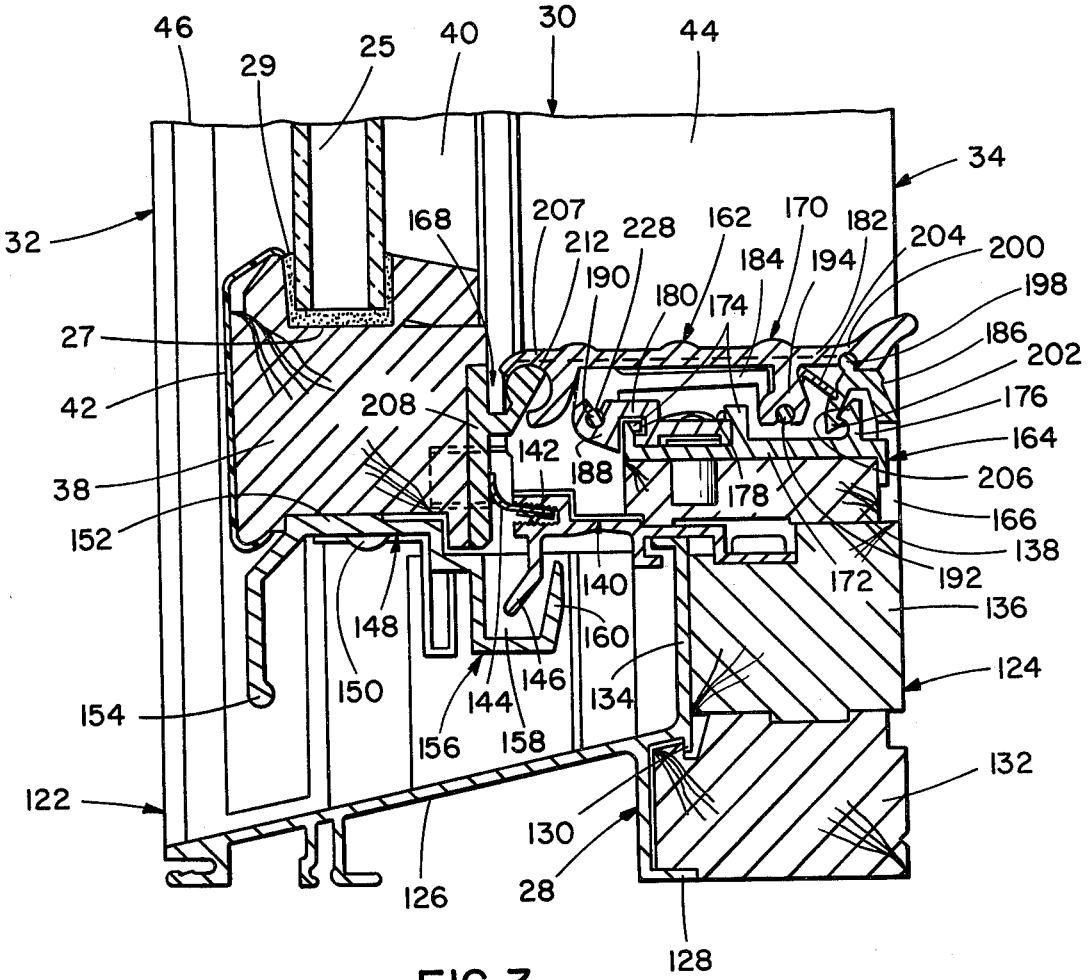
FIG. 3 is an enlarged sectional view taken along line 3—3 of FIG. 1 illustrating the window when in the locked position, showing the interrelationship between the sill of the frame, the lower rail of the sash, and the operator-latch member for securing the sash in place within the frame.

Referring to FIG. 3, a cross-sectional view is shown of the sill 28 of the frame 22 and the lower rail 38 of the sash 24. The sash 24 includes an exterior metal portion 122 and an interior wood portion 124 which is rigidly interconnected to the exterior metal portion 122. The metallic sill portion 122 includes a lower, outwardly and downwardly angled wall 126 which is constructed and arranged to cause the flow of rain water downwardly and outwardly away from the window assembly 20. The angled wall 126 is positioned directly below the lower rail 38 of the sash 24. The angling of the wall 126 substantially assures that all water and moisture is directed, by gravity, away from the window assembly 20.

The metal sill portion 122 includes interconnecting legs 128 and 130 which are slidably and securely received by a lower wood section 132 of the interior wood portion 124 of the sill 28. An upwardly projecting protective wall 134 extends from the inner portion of the angled wall 126. The upright wall 134 provides weather protection for the wood sill 124 and particularly the intermediate wood section 136 of the sill 28. The intermediate wood section 136 is fixedly secured to the lower wood section 132 and an upper wood strip 138 is secured to the upper surface of the intermediate wood sill section 136. The lower wood section 132, the intermediate wood section 136, and the upper wood strip 138 are rigidly interconnected together to define the interior wood portion 124 which, in turn, is rigidly interconnected to the exterior extruded metallic sill portion 122, the sections 122 and 124 defining the sill 28.

A unitary, extruded aluminum arm 140 is rigidly secured between the upper wood strip 138 and the intermediate wood strip 136 and projects laterally outwardly therefrom. The arm 140 also abuts against the upper edge of the upright metallic wall 134 of the metal sill section 122. The outer portion of the projecting arm 140 includes a holder portion 142 which receives a flexible weather strip 144. The weather strip 144 is constructed and arranged to sealably bear against the inner, lower face of the lower rail 38 of the sash 24 at a position which is below the upper surface of the upper wood strip 138. A downwardly projecting leg 146 projects below the holder portion 142 and functions as a wind break and acts to shed water from between the sash 24 and frame 22.

Referring to FIG. 3, an extruded aluminum weather guard 148 is secured by screws 150 to the bottom edge of the lower rail 38 of the sash 24. The screws 150 pass through a continuous base portion 152 of the weather guard 148 which extends along the entire lower surface of the bottom rail 38. An outer leg 154 extends downwardly from the exterior edge of the base 152 and is positioned below the outer clad surface of the lower rail 38. The leg 154 acts to direct water flowing downwardly from the window glass and the sash 24 to the angled sill 126 for directing water away from the window assembly 20. The inner edge portion of the base 152 has a continuous downwardly projecting unitary wind guard 156. The wind guard 156 includes a channel portion 158 which, in the closed and locked position of the window assembly 20, is positioned on opposite sides of the downwardly projecting leg 146 of the arm 140. The upright inner side wall 160 of the channel 158 cooperates with the downwardly projecting leg 146 to provide added assurance that the sash 23 remains secure within the frame 22 when the window assembly 20 is in the upper, closed and locked position, because of negative wind load, mentioned earlier. The channel 158 and leg 146 also cooperate to avoid the leakage of rainwater past the seal 144 because of the tortuous path created for water, which also tends to fall by gravity.

Referring particularly to FIGS. 3, 10, 12, 13 and 14, the window operator-latching assembly or mechanism, generally 162, is shown in detail. The operator-latch assembly 162, has several important functions. First, the assembly 162 acts to normally lock the window assembly 20 in the closed and locked position, that is, the operator-latch assembly 162 maintains the sash 24 in a closed and locked position relative to the frame 22. Secondly, the operator-latch assembly 162 is constructed and arranged to permit the partial opening of the sash 24 to a vent position relative to the frame 22 by permitting partial outward pivoting of the sash 24 on the pivot pins 60 relative to the frame 22. Thirdly, the operator-latch assembly 162 functions to lift the sash 24 vertically upwardly relative to the frame 22 when the sash 24 is being moved from the open position to the upper, closed position. Finally, the latch-operator assembly 162 acts, substantially alone, to hold the sash 24 in the upper, closed, and locked position. The latch-operator assembly 162 and its various important functions will be described hereinafter in detail.

Figure 13:
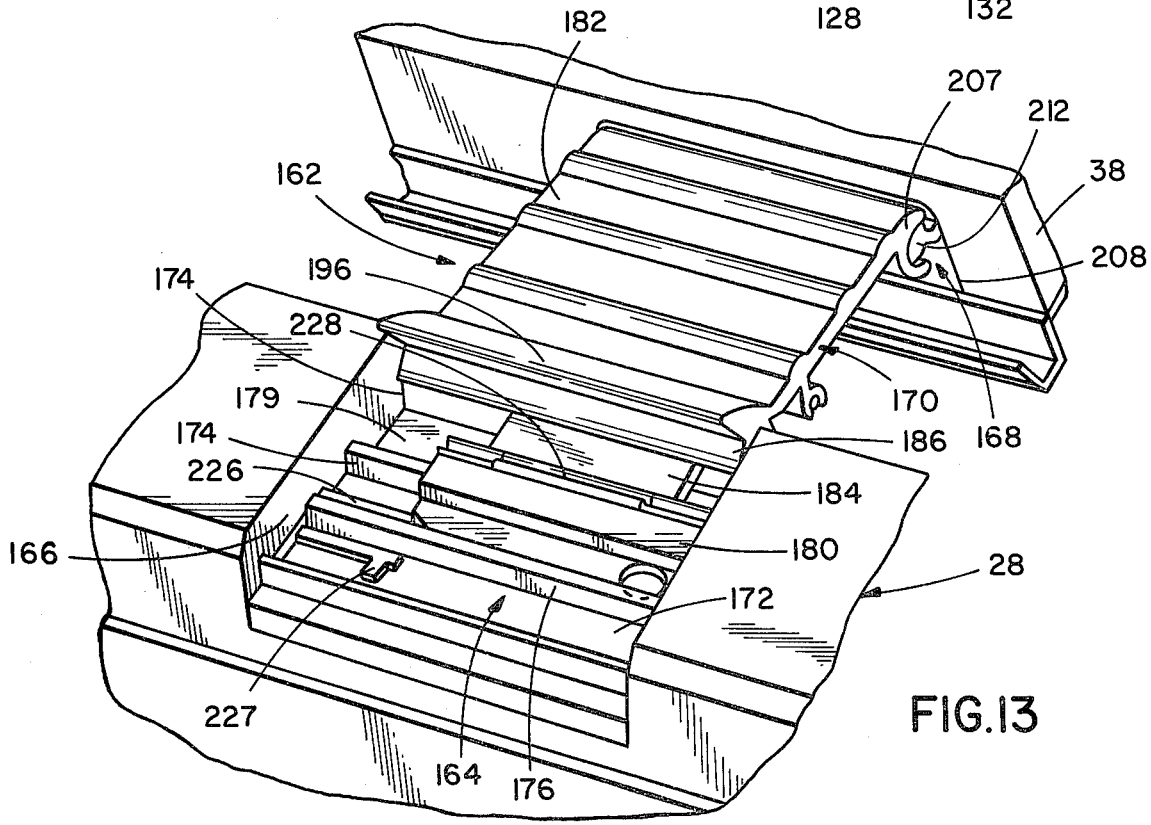
FIG. 13 is an enlarged pictorial view of the operator-latch mechanism shown in the position of FIG. 12.

Referring to FIG. 13, the principal constructional elements of the operator-latch assembly 162 are shown. The principal elements of the operator-latch assembly 162 include a fixed base portion 164, which is fixedly secured to the central portion of the wood portion 124 of the sill 28, as seen, for example, in FIG. 1, the base portion 164 being received within a cut-out portion 166 defined in the upper wood strip 138 of the wood portion 124 of the sill 28. The operator-latch assembly 162 further includes a fixed pivot member 168 which is rigidly secured to the lower inner face of the lower rail 38 of the sash at the central portion thereof. The third principal element of the operator-latch assembly 162 includes the movable operator section, generally 170, which operatively interconnects the base portion 164 on the frame 22 to the pivot member 168 which is rigidly secured to the sash 24.

The base portion 164 of the operator 162 includes a flat lower plate 172 with a pair of upwardly projecting, guide track defining legs 174 and an upwardly projecting latch element 176, spaced inwardly therefrom. As seen, for example, in FIG. 12, each guide leg 174 includes flanges 178. The flanges 178 project towards each other to define a guide track 179, the purpose of which will be hereinafter described.

Figure 12:
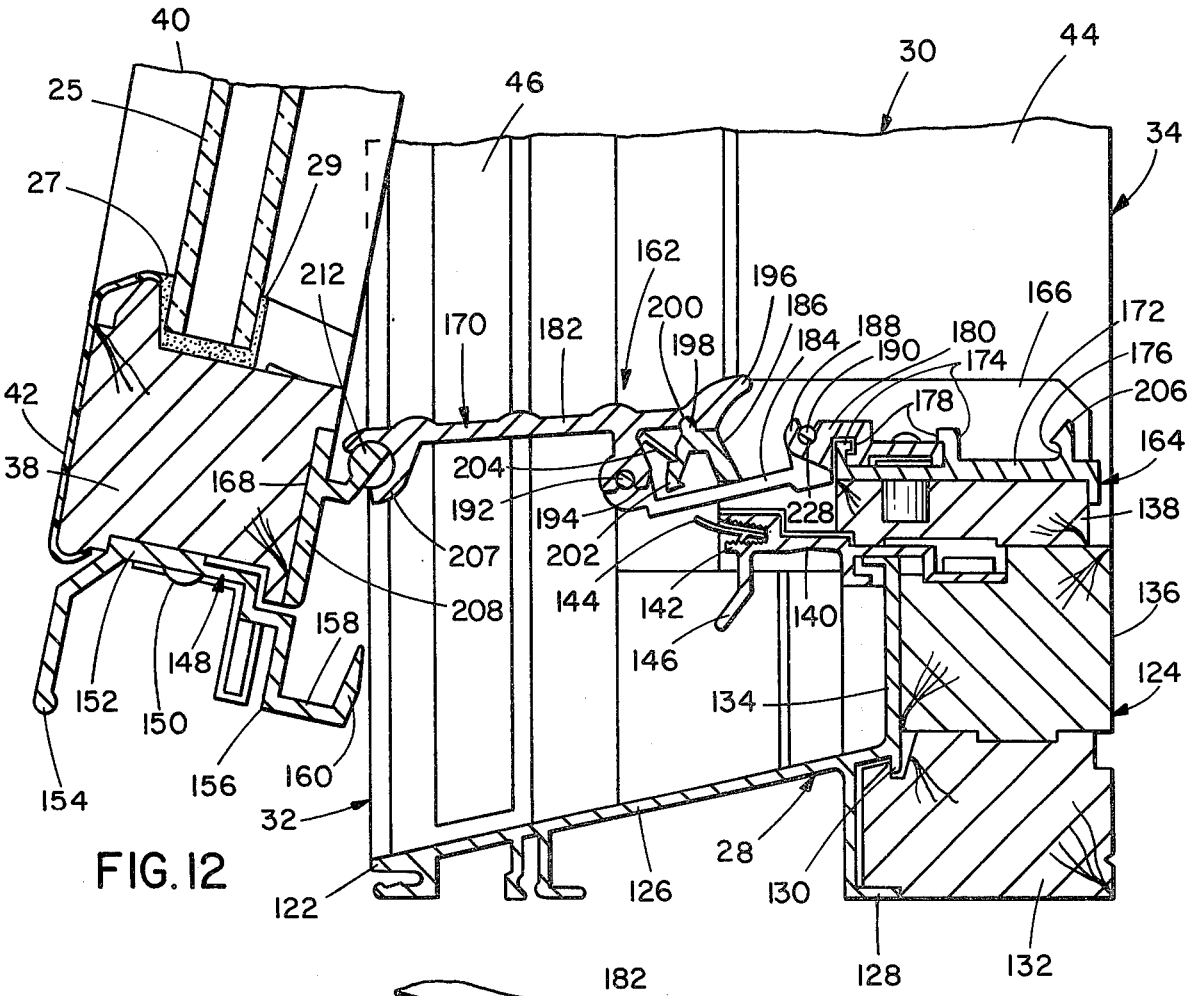
FIG. 12 is a sectional view, similar to FIGS. 3 and 10, illustrating the window sash in a partially pivoted, open position while the operator-latch member remains in engagement therewith.

The operator section 170 of the operator-latch assembly 162 includes a slide plate 180, an operator plate, generally 182, a link element, generally 184, which operatively interconnects the slide plate 180 to the operator plate 182, and a release bar 186. As seen in FIGS. 3 and 12, for example, the slide plate 180 is slidably carried within the guide track 179 defined by the guide legs 174 and flanges 178 and permits lateral movement of the plate 180 from the position shown in FIG. 13 to the position shown in FIG. 14. The lateral movement of the slide plate 180 in the guide track moves the operator section 170 of the assembly 162. The purpose of shifting the slide plate 180, the operator plate 182, and link 184 is to effect complete disengagement of the sash 24 from the operator-latch assembly 162.

The fixed slide plate 180, on the sash side thereof, includes a unitary pivot support portion 188. The link member 184 includes a unitary pivot pin 190 which is rotatably received within the pivot support portion 188 of the slide plate 180 so that the link 184 is pivotally mounted relative to the slide plate 180, as seen, for example, in FIG. 10, about the pivot portion 188.

The opposite end of the interconnecting link 184 also includes a unitary pivot pin 192. The operator plate 182 includes a downwardly extending pivot support portion 194 for rotatably carrying the pivot pin 192 and the link 184 so that the link 184 is pivotally interconnected to the operator plate 182. The pivot support 194 is spaced laterally inwardly, toward the sash 24, relative to the release bar 186. The interior end of the operator plate 182 includes an upturned portion 196 which facilitates the normal operation of the operator plate 182. Adjacent and below the upturned portion 196, the release bar 186 is pivotally mounted. The release bar 186 includes a unitary pivot pin portion 198 which is rotatably carried within the lower surface of the operator plate 182, as seen, for example, in FIG. 10. The opposite end of the operator plate 182, that is, the end adjacent the window sash 24, includes a pivot support portion 207. The pivot support portion is substantially cylindrical in shape and a gap of more than 180° and less than 270°, preferably about 210° is provided therein.

Referring to FIG. 3, the release bar 186 includes an inwardly projecting hook portion 202, which, in the closed position, is constructed and arranged to engage the hook portion 206 of the latch element 176 provided on the lower plate, 72. A leaf spring 204 is positioned between the pivotal release bar 186 and the pivot support between the pivotal release bar 186 and the pivot support portion 194 of the operator plate 182. The spring 204 normally maintains the release bar 186 pivotally biased outwardly away from the pivot support 194 and, when in the closed position, as seen in FIG. 3, the hook portion 202 engages the hook portion 206 on the latch element 176. In this engaged position, the release bar 186 maintains the operator-latch assembly 162 in the closed, locked position, as seen, for example, in FIG. 3.

Figure 14:
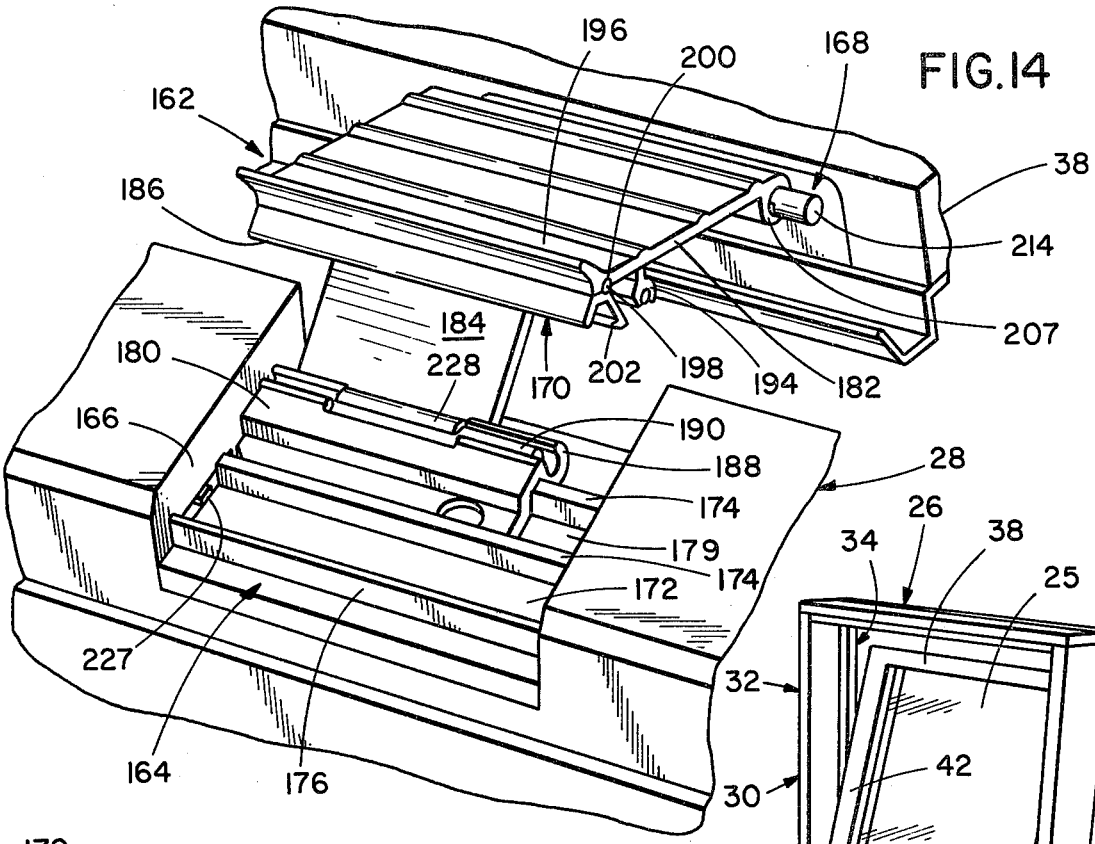
FIG. 14 is a pictorial view, similar to FIG. 13, except showing the operator-latch member in position for disengagement from the window sash.
Figure 15:
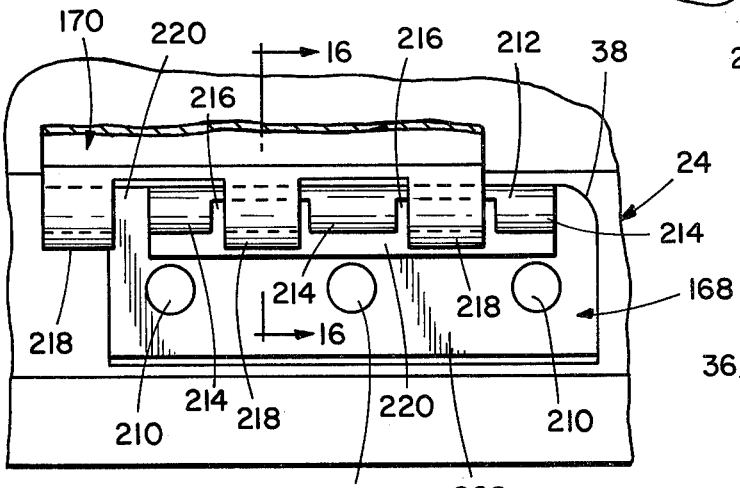
FIG. 15 is a detailed sectional view showing the interengagement between portions of the latching member relative to the sash.
Figure 16:
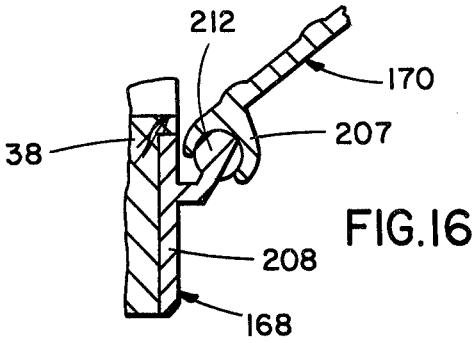
FIG. 16 is a detailed sectional view taken along the line 16—16 of FIG. 15.
Figure 17:
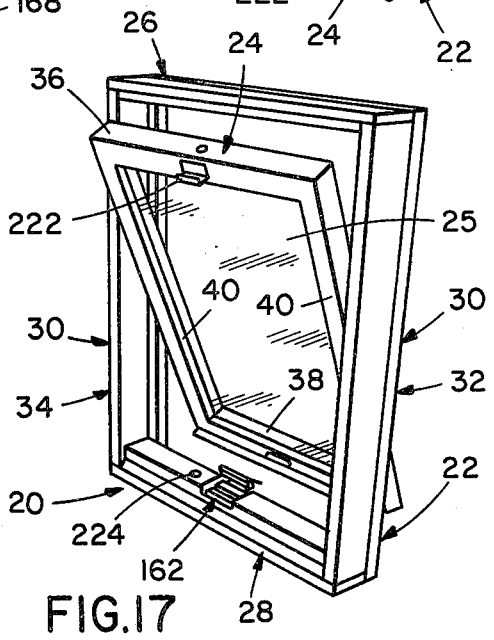
FIG. 17 is a pictorial view illustrating the window sash disengaged from the latch-operator member.

The pivot member 168, mounted on the lower rail 38 of the sash 24, is constructed to rotatably interengage the pivot support portion 207 of the operator plate 182. Referring to FIGS. 14, 15 and 16, the pivot member 168, of unitary construction, includes a base 208 which is rigidly secured to the lower central portion, of the lower rail 38 of the sash 24 by means of screws 210. A pivot pin portion 212, as seen in FIG. 16, projects upwardly and outwardly from the base 208 and is substantially circular in cross-section and is constructed and arranged to rotatably engage the pivot support section 207 of the operator plate 182. As seen best in FIG. 15, the pivot portion 212 includes three separate cylinder sections 214 which are separatd by two cut-out sections 216. The pivot support 207 of the operator plate 182 includes three pivot sections 218 which are spaced apart by two cut-out sections 220. The pivot sections 218 of the plate 182 are constructed and arranged to pivotally receive each of the three cylinder sections 214 of the pivot member 168, when the operator-latch 162 is in position for interconnecting the sash 24 and the frame 22. After the slide plate 180 has moved the operator plate 182 to the unlocked or disengaged condition, the positioning of the cylinder sections 214 relative to the pivot sections 218 permits the separation of the pivot support 207 from the pivot member 168, thereby totally separating the operator-latch assembly 162 from interengagement with the sash 24, thereby permitting pivoting of the sash 24 about the horizontal axis defined by the pivot pins 60.

Figure 18:
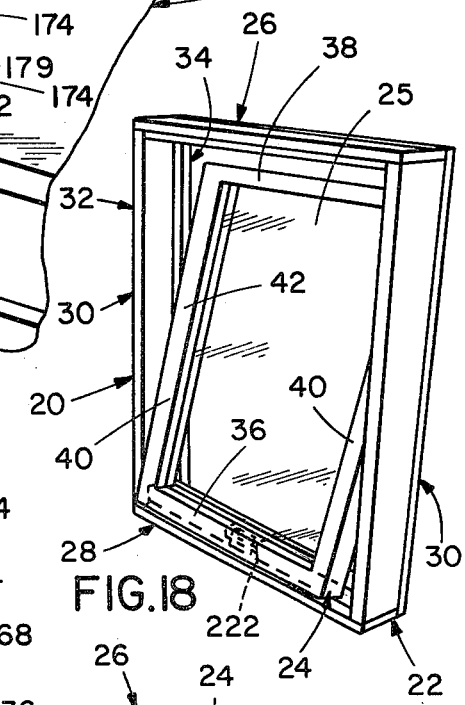
FIG. 18 is a pictorial view of the window sash pivoted so that the normal exterior side is positioned on the inside of a room.

When it is desired to work on the normally exterior side of the sash 24, as for window washing, it is desirable to include a holder 222 which is fixedly secured to the inner central portion of the upper rail 36. The holder 222 is constructed and arranged to engage the base portion 164 of the operator-latch assembly 162, as seen in FIG. 18, to thereby hold the sash 24 in a relatively fixed position when it is desired to wash the normal exterior of the window from a position inside of a room in which the window 20 is installed.

Although it is believed that the foregoing fully describes our invention, it is believed that our invention will be even more clearly understood by a brief description of the manner of operation or of use of the window construction 20.

Figure 2:
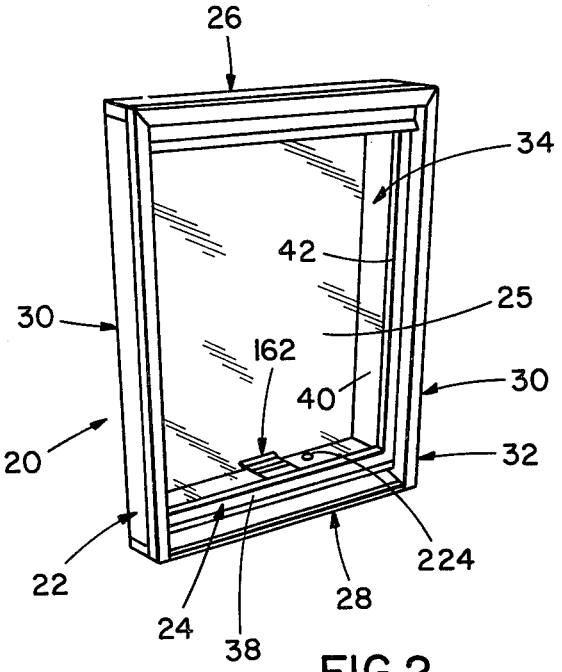
FIG. 2 is a pictorial view of the window construction of FIG. 1, but showing the window from the exterior.

Referring to FIGS. 1, 2 and 3, the window 20 is shown in the closed and locked position. In the closed and locked position, the window sash 24 is also in the upper position relative to the frame 22, that is, in the position shown in FIG. 3, at which the relative positions of the lower rail 38 and the upper rail 36 of the sash 24 to the frame 22, are shown. In this position, the sash 24 is weather sealed relative to the frame 22 by the upper flexible seal 112, by the seals 41 and 43 provided between the jambs 30 and the stiles 40, as seen in FIG. 5, and by the weather strip 144, on the sill 28, bearing against the lower rail 38. Also, the sash 24 is maintained in a fixed position within the frame 22 so that sideways, forward and rearward, and upward and down movement of the sash 24 is prevented. The relative positioning of the upright stiles 40 of the sash 24 and the upright jambs 30 of the frame 22 substantially prevents sideways movement of the sash. The pivot pins 60 mounted on the stiles 40 interconnect the sash to the frame 22 by connection with the spring brackets 66 which are slidably carried within the guide tracks 82 which, in turn, are fixed to the jambs 30 of the window frame 22. Upward movement of the sash 24 relative to frame 22 is prevented by the head 26 and the upper rail 36. The interlock assembly 144 at the central upper edge of the upper rail 36 and on the underside of the head 26 assists in preventing lateral or sideways and forward and rearward movement of the sash 24 within the frame 22.

The sash 24 is held in the upper, closed, and locked position solely by action of the operator-latch assembly 162 acting in cooperation with the frame 22 and the sash 24. Specifically, when the operator-latch assembly 162 is in the position shown in FIG. 3, the pivot sections 218 of the pivot support portion 207 of the operator plate 182 positively engage with the cylinder pivot portions 212 of the pivot member 168 which is mounted on the lower central portion of the lower rail 38 of the sash 24. One of the important functions of the operator-latch assembly 162 is the maintenance of the sash 24 in the upper, closed anc locked position, the operator-latch assembly providing the sole means for holding the sash in the upper, closed and locked position.

Referring again to FIGS. 3 and 4, when the sash 24 is in the upper, closed and locked position, the upper exterior portion of the upper rail 36 of the sash 24 extends upwardly beyond the lower edge of the rain deflector or flange 108 on the exterior-head portion 98, providing added assurance that the sash 24 cannot be moved outwardly relative to the frame 22. In a similar way, the leg 146 on the metal strip 142 on the sill 28 engages within the channel 158 which is mounted on the sash 24. Thus, there is added assurance, at both the top and the bottom of the sash 24, that the sash 24 may not be moved outwardly relative to the frame 22. Thus, there are a number of ways by which there is assurance that the sash 24 remains positively weather sealed and interlocked relative to the frame 22. The operator-latch assembly 162 assures the maintenance of the sash 22 in the upper position, as discussed above.

When it is desired to unlock the window, the operator must first open a lock 224, on the sill 28 by inserting a key thereinto. As seen in FIG. 13, the slide plate 180 is shown in the locked position. When the lock 224 is operated, the lock plate 226 for the slide plate is slide inwardly and out of interfering engagement with the edge of the slide plate 180. In addition to holding the slide plate 180 in position, the outer section 227 of the lock plate 226 prevents operation of the release bar 186. In this way, the lock 224 normally prevents operation of the release bar 186 and prevents sliding of the slide plate 180 from the position of FIG. 13 to that of FIG. 14. An alternative embodiment (not shown) permits pivoting of the sash to the vent position without operating the lock; to open the window beyond the vent position, a key must be used.

Figure 10:
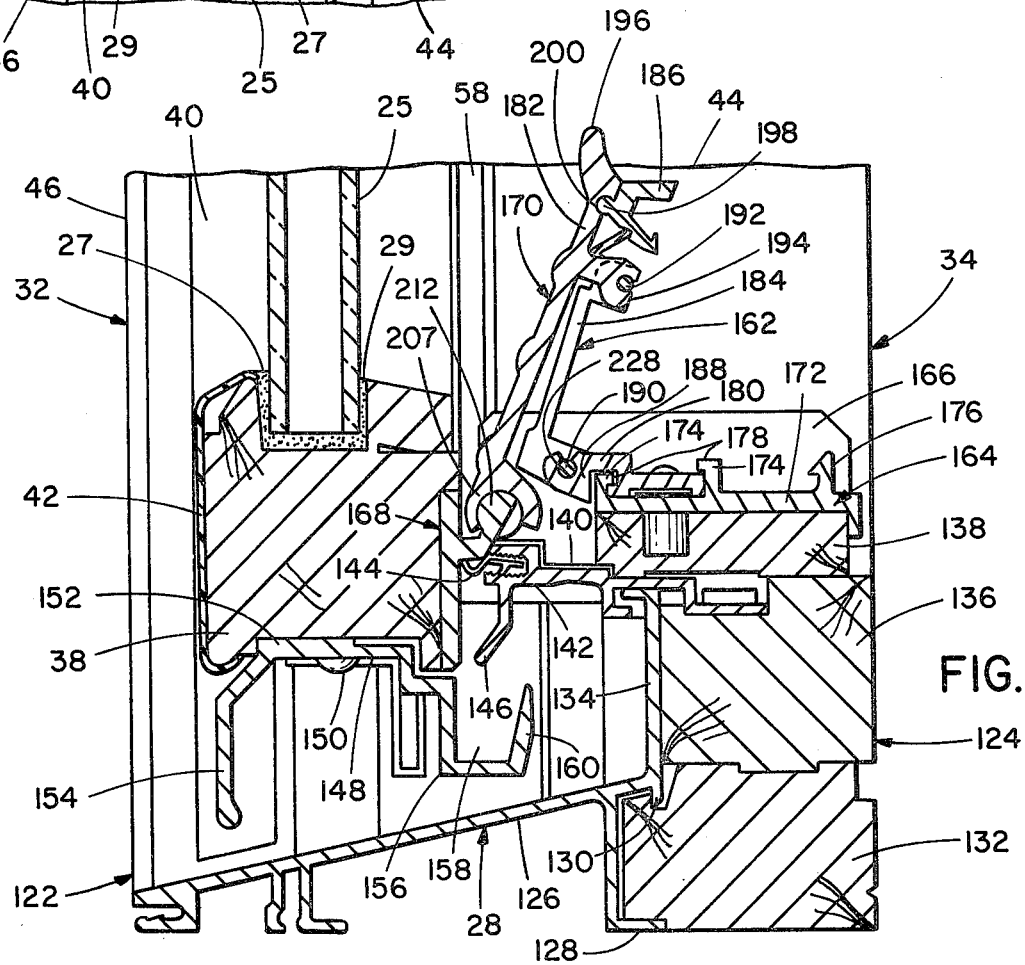
FIG. 10 is an enlarged sectional view, similar to FIG. 3, except illustrating the operator-latch member in the released position and with the window sash lowered relative to the window frame.

After the lock 224 has been operated to move the lock plate 226 and release bar lock 227 to the open position, the operator-latch assembly 162, referring to FIG. 10, is activated by pressing inwardly on the release bar 186 against the biasing force of the biasing spring 204 so as to disengage the hook portion 202 from the hook portion 206. As soon as the release bar is thus operated, the pivot interconnection between the slide plate 180 and the link 184 at the pivot support portion 188 acts as a fulcrum. The weight of the window sash 24 has been held in the upper position solely by the interengagement of the release hook elements 204 and 206 and by cooperation of the pivot section 218 of the operator plate 182 with the cylindrical pivot sections 214. Upon release of the latch element 204 and 206, the weight of the sash causes downward movement of the sash 24 relative to the frame 22, from the position of FIG. 3 and FIG. 4 to the position of FIG. 10 and FIG. 11; there is still interlocking engagement between the operator-latch assembly and the window sash 24. If desired, simply by pivoting the link 184 and the operator plate 182, which co-operate to act as a toggle connection, to a fully extended position, such as shown in FIG. 13, the window sash 24 may be opened to a vent position, as also seen in FIG. 12. When moving to the vent position, the sash 24 is pivoted relative to the frame 22 about the horizontal axis defined by the pivot pins 60, which are horizontally aligned with each other within the upright stiles 40 of the sash 24.

When it is desired to completely rotate the sash 24 relative to the frame 22 about the pivot pins 60, the slide plate 180 and thereby the link 184 and operator plate 182 are slid laterally sideways, to the position shown in FIG. 14. At this time, the cylinder pivot sections 214 of the pivot member 168 are aligned with the cut-out sections 220 of the pivot support portion 207 of the operator plate 182, as best shown in FIG. 15. At this position, the operator plate 182 is totally disengaged from the pivot member 168 on the sash 24 to thereby totally release the sash 24 from the operator-latch assembly 162. The sash 24, being totally separated from latch 162, may be pivoted about the pivot pins 60 so that the normal exterior of the window may be washed, as seen in FIG. 18. Desirably, the holder 222 is placed into temporary engagement, as by resting thereon, with the fixed plate 172, as seen in FIG. 18, in order to hold the sash 24 in a fixed position relative to the frame 22 during washing of the window.

After it is desired to return the window to the closed and locked position, as after completing maintenance of the window, as washing thereof, the holder 222 is disengaged from the plate 172. The window is then pivoted until the lower rail of the sash is brought into close proximity with the operator-latch assembly 162. At this time, the pivot portion 212 of the pivot member 168 and the pivot support portion 200 are placed into alignment as seen in FIGS. 14, 15 and 16 and the slide plate 180 and thereby the operator-latch assembly 162 are slid laterally to the position shown in FIG. 13. The link 184 and operator plate 182 are then returned from the position of FIGS. 12 and 13 to the position of FIG. 10 and FIG. 11. At this point, the operator plate 182 is pivoted about the fulcrum at the support 207 with sufficient force to overcome the weight of the windown sash 24. In addition, the tension springs 94, on which the pivot pins 60 are carried, assist in the upward lifting of the window sash 24 relative to the frame 22. This is a distinct advantage because the window 20 may be rather large and the springs 94 may provide a significant upward lifting force on the sash 24, in combination with the lever action of the operator plate 182 about the fulcrum for lifting the sash 24 to the upper portion. In this manner, the springs 94 are operatively associated with the operator plate 182 during the upward lifting of the sash 24 relative to the frame 22 while at the same time the jambs 30 and stiles 40 remain in substantial longitudinal alignment and are relatively moved during the upward movement of the sash 24. During the downward pivoting of the operator plate 182 to lift the sash 24, the distance between the outer end of the operator plate 182 and the pivot or fulcrum at the pivot support 207 provides a mechanical advantage for the operator to assist in lifting of the sash 24, together with the biasing action of the springs 94.

As the operator plate approaches the horizontal position, the release bar 186 engages the latch element 176 on the base portion 164 in order to provide for positive inerlocking engagement therebetween. At this point, the window is in the closed, locked and upper position. In order to assure that the window cannot be operated by unauthorized persons, the operator operates a key within the lock 224 so as to make the opening and closing of the window impossible, except for authorized persons.

It is seen from the foregoing that a number of important advantages have resulted from the invention. All of the objects previously set forth have been accomplished. The applicants have provided a highly simply and uniquely constructed pivot window construction which is highly effective in operation and includes a simple operator-latch mechanism 162 which serves mutiple purposes, including an upper holding force, an operating mechanism and an upper lifting force. Tension springs 94 bias the sash 24 upwardly and cooperate with the lever action provided by the operator-latch assembly 162 in lifting the sash 24 to the upper, closed and locked position.

While in the foregoing there has been provided a detailed description of a particular embodiment of the present invention, it is to be understood that all of the equivalents obvious to those having skill in the art are to be included within the scope of the invention, as claimed.

What we claim and desire to secure by Letters Patent is:

1. A window construction comprising, in combination, a fixed window frame having a sill, a head, and a pair of upright jambs interconnecting said sill with said head, a window sash having upper and lower rails and upright stiles interconnecting said upper and lower rails, means for supporting said sash within said frame for movement between a closed and locked position and an open and an unlocked position, said supporting means including means for pivotally mounting said sash within said frame for movement about a substantially horizontal axis for making the normal exterior side of said window accessible from the interior side when said sash is in said open and unlocked position, said pivotal mounting means including a rigid member projecting laterally from each of said stiles towards each of said jambs, means on each of said jambs for securely receiving said rigid members, said receiving means including a guidably mounted member vertically movable longitudinally of said jambs so that said sash is vertically movable relative to said frame, means interconnecting said receiving means and said frame for normally biasing said sash to said upper position, said supporting means further including means for vertically moving said sash between an upper position and a lower position when said stiles and said jambs are substantially co-extensive with each other, and cooperating means mounted on said sash, on said frame and on said vertical moving means for preventing sidewise, front and back, and upward and downward movement of said sash within said frame when said sash is in said closed and locked position.

2. The window construction of claim 1 wherein said pivotal mounting means includes separate members on each of said stiles in substantial horizontal alignment, said horizontal axis being located slightly above the central portion of said sash so that said sash is normally tilted by gravity to the closed position.

3. The window construction of claim 1 wherein said biasing means cooperate with said vertical moving means for assisting in lifting said sash vertically upwardly relative to said frame when said stiles and said jambs are in substantially co-extensive longitudinal alignment with each other.

4. The window construction of claim 1 wherein said vertical moving means comprises the sole means for holding said sash in said upper position when said sash is in closed and locked position.

5. The window construction of claim 1 wherein said sash has a height which is slightly less than the height of said frame for providing limited relative vertical movement between said sash and said frame.

6. The window construction of claim 1 wherein said vertical moving means is operatively interconnected to both said frame and said sash.

7. The window construction of claim 1 wherein said vertical moving means includes means for selectively interconnecting said sash to said frame, at a first position, and for disconnecting said frame from said sash, at a second position.

8. The window construction of claim 7 wherein said selective means permits movement of said sash to a vent position, at said first position, wherein said lower rail is spaced from said sill, said sash being pivoted laterally outwardly relative to said frame.

9. A window construction comprising, in combination, a fixed window frame having a sill, a head, and a pair of upright jambs interconnecting said sill with said head, a window sash having upper and lower rails and upright stiles interconnecting said upper and lower rails, means for supporting said sash within said frame for movement between a closed and locked position and an open and an unlocked position, said supporting means including means for pivotally mounting said sash within said frame for movement about a substantially horizontal axis for making the normal exterior side of said window accessible from the interior side when said sash is in said open and unlocked position, said supporting means further including means for vertically moving said sash between an upper position and a lower position when said stiles and said jambs are substantially co-extensive with each other, said vertical moving means including a toggle linkage having a first link operatively and pivotally interconnected to said sill, a second link operatively and pivotally interconnected to said lower rail, and cooperating means mounted on said sash, on said frame and on said vertical moving means for preventing sidewise, front and back, and upward and downward movement of said sash within said frame when said sash is in said closed and locked position.

10. The window construction of claim 9 wherein said pivotal interconnection between said lower rail and said second link includes means for selectively disconnecting and connecting said second link from and to said sash so that said sash may be completely disconnected from said vertical moving means, thereby permitting pivoting of said sash about said substantially horizontal axis for making the normal exterior side of said window accessible from the interior side.

11. The window construction of claim 9 including means for selectively engaging and disengaging said links to and from said sash.

12. The mechanism of claim 11 including means for releasing said selective means, said sash moving downwardly relative to said frame upon operation of said releasing means by the action of gravity.

13. A window construction comprising, in combination, a fixed window frame having a sill, a head, and a pair of upright jambs interconnecting said sill with said head, a window sash having upper and lower rails and upright stiles interconnecting said upper and lower rails, means for supporting said sash within said frame for movement between a closed and locked position and an open and an unlocked position, said supporting means including means for pivotally mounting said sash within said frame for movement about a substantially horizontal axis for making the normal exterior side of said window accessible from the interior side when said sash is in said open and unlocked position, said supporting means further including means for interconnecting said frame jambs to said sash stiles and for normally biasing said sash to said upper position, said biasing means cooperating with said vertical moving means for moving said sash from said lower position to said upper position when said stiles and said jambs are substantially longitudinally co-extensive with each other, said supporting means also including means for vertically moving said sash between an upper position and a lower position when said stiles and said jambs are substantially co-extensive with each other, and cooperating means mounted on said sash, on said frame and on said vertical moving means for preventing sidewise, front and back, and upward and downward movement of said sash within said frame when said sash is in said closed and locked position.

14. In a window construction having a frame with a sill, a head, and a pair of upright jambs interconnecting the sill and the head, a sash within said frame with an upper rail, a lower rail and upright stiles interconnecting the opposite ends of said rails, and means for mounting said sash within said frame for movement between a closed position and an open position, an improvement comprising, in combination, means for pivotally mounting said sash within said frame for movement about a substantially horizontal axis for making the normal exterior side of said window accessible from the interior side, said pivotal mounting means includes a rigid member projecting from each of said stiles towards each of said jambs, means mounted on each of said jambs for receiving each of said rigid members, said receiving means including a guidably mounted movable member on each of said jambs, said movable member being vertically movable longitudinal of said jambs so that said sash is vertically movable relative to said frame between an upper position and a lower position, means interconnecting said receiving means and said frame for normally biasing said sash to said upper position, and a mechanism secured to both said frame and to said sash for opening and closing said sash, and for supporting said sash in said upper position, said mechanism comprising the sole means for maintaining said sash in said upper position.

15. The improvement of claim 14 wherein said pivotal mounting means includes separate members on each of said sash stiles in substantial horizontal alignment, said horizontal axis being located slightly above the central portion of said sash so that said sash is normally tilted by gravity to the closed position.

16. The improvement of claim 14 wherein said biasing means cooperates with said mechanism for assisting in lifting said sash upwardly relative to said frame when said stiles and said jambs are in substantially co-extensive longitudinal alignment with each other.

17. In a window construction having a frame with a sill, a head, and a pair of upright jambs interconnecting the sill and the head, a sash within said frame with an upper rail, a lower rail and upright stiles interconnecting the opposite ends of said rails, and means for mounting the opposite ends of said rails, and means for mounting said sash within said frame for movement between a closed position and an open position, an improvement comprising, in combination, means for pivotally mounting said sash within said frame for movement about a sustantially horizontal axis for making the normal exterior side of said window accessible from the interior side, means for vertically guidably supporting said sash within said frame for movement through a limited vertical distance between an upper position and a lower position, a mechanism secured to both said frame and to said sash for opening and closing, and for supporting said sash in said upper position, said mechanism comprising the sole means for maintaining said sash in said upper portion, said mechanism including a toggle linkage having a first link operatively and pivotally interconnected to said sill and a second link operatively and pivotally interconnected to said lower rail, said pivotal connection between said lower rail and said second link including means for selectively disconnecting and connecting said second link from and to said sash so that said sash may be completely disconnected from said mechanism, to thereby permit pivoting of said sash about said substantially horizontal axis for making the normal exterior side of said window accessible from the interior side.

18. In a window construction having a fixed window frame with a sill, a head, and a pair of upright jambs interconnecting said sill and said head, a sash within said frame and with an upper rail, a lower rail, and upright stiles interconnecting the opposite ends of said rails, means for mounting said sash within said frame for movement between a closed position and an open position, and means for controlling the position of said sash relative to said frame, an improved controlling means comprising, in combination, a fixed member rigidly mounted on said sill, a fixed member rigidly mounted on said lower rail, a first link member pivotally interconnected to said fixed member on said sill, a second link member pivotally interconnected to said first link member and to said fixed member on said lower rail, a latch element on said second link member, a latch element on said fixed member on said sill for interlocking with said latch element on said link member for holding said sash in a closed position relative to said frame, said latch elements being constructed and arranged to be movable to a disengaged position upon selective manual operation for movement of said sash to an open position, a plate member slidably carried by said fixed member on said sill for lateral movement of said entire mechanism, said pivotal interconnection between said first link member and said fixed member on said sill being located on said slidable plate member, said second link member also being laterally slidable along the pivotal interconnection between said second link member and said fixed member on said lower rail, said link members defining first and second positions relative to said fixed members on said sill and on said lower rail.

19. The improvement of claim 18 wherein, at said first position, said second link member and said fixed member on said lower rail are interconnected and, at said second position, said second link member and said fixed member on said lower rail are disconnected from each other so as to release said sash from said interconnection with said controlling means for permitting movement of said sash to the open position.

20. The improvement of claim 18 wherein said sash mounting means includes means for vertically guidably supporting said sash within said frame for movement through a limited vertical distance between an upper position and a lower position, said improved controlling means maintaining said sash in said upper position and defining the sole means for maintaining said sash in said upper position.

21. The improvement of claim 20 including means for latching said second link member to said fixed member on said sill for maintaining said sash in said upper position, said latching means being selectively releasable, so that said sash moves by gravity through said limited vertical distance and pivots said link members about the pivotal interconnection between said fixed member on said sill and said first link member, defining a fulcrum.

22. The improvement of claim 21 wherein said fulcrum provides a mechanical advantage for lifting said sash through said limited vertical distance upon downward pressure being applied to said link members, for raising said sash to said upper position.

23. The improvement of claim 22 including means for normally biasing said sash to said upper position to thereby assist in the movement of said sash to said upper position of said sash relative to said frame.

24. In a window construction having a fixed window frame with a sill, a head, and a pair of upright jambs interconnecting said sill and said head, a sash within said frame and with an upper rail, a lower rail, and upright stiles interconnecting the opposite ends of said rails, means for mounting said sash within said frame for movement between a closed position and an open position, and means for controlling the position of said sash relative to said frame, an improved controlling means comprising, in combination, a fixed member rigidly mounted on said sill, a fixed member rigidly mounted on said lower rail, a first link member pivotally interconnected to said fixed member on said sill, a second link member pivotally interconnected to said first link member and to said fixed member on said lower rail, a latch element on said second link member, a latch element on said fixed member on said sill for interlocking with said latch element on said link member for holding said sash in a closed position relative to said frame, said latch elements being constructed and arranged to be movable to a disengaged position upon selective manual operation for movement of said sash to an open position, said first and second links being laterally slidable relative to both of said fixed members on said lower rail and on said sill, the pivotal interconnection between said second link member and the pivotal interconnection thereof to said fixed member on said lower rail defining a first position at which the parts are interconnected and a second position at which the parts may be disconnected from each other.

* * * * *